US009193091B1

(12) United States Patent
Conklin

(10) Patent No.: US 9,193,091 B1
(45) Date of Patent: Nov. 24, 2015

(54) CHAINSAW BLADE STORING ASSEMBLY

(71) Applicant: Frederick Conklin, Canton, OH (US)

(72) Inventor: Frederick Conklin, Canton, OH (US)

( * ) Notice: Subject to any disclaimer, the term of this patent is extended or adjusted under 35 U.S.C. 154(b) by 19 days.

(21) Appl. No.: 14/267,662

(22) Filed: May 1, 2014

(51) Int. Cl.

| | |
|---|---|
| ***A45C 11/26*** | (2006.01) |
| ***B27B 17/00*** | (2006.01) |
| ***B25H 3/00*** | (2006.01) |
| ***B65D 25/10*** | (2006.01) |

(52) U.S. Cl.
CPC ..... *B27B 17/0008* (2013.01); *B25H 3/006* (2013.01); *B65D 25/10* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,125,207 | A | 11/1978 | Ernst et al. | |
| 4,905,948 | A | 3/1990 | Indorf | |
| 5,119,937 | A | 6/1992 | Reynolds, Jr. | |
| 5,392,910 | A | 2/1995 | Bell et al. | |
| 6,325,251 | B1 | 12/2001 | Santos | |
| 7,624,862 | B1 | 12/2009 | Pleggenkuhle | |
| D672,145 | S | 12/2012 | Buie, II | |
| 8,857,612 | B2 * | 10/2014 | Crank et al. | 206/349 |
| 2005/0139499 | A1 * | 6/2005 | Flynn | 206/349 |
| 2005/0230279 | A1 * | 10/2005 | Brady | 206/349 |
| 2009/0152149 | A1 * | 6/2009 | Allen | 206/373 |
| 2010/0229405 | A1 | 9/2010 | Lank | |

FOREIGN PATENT DOCUMENTS

| | | |
|---|---|---|
| CN | 101837489 | 9/2010 |
| CN | 203111807 U | 8/2013 |

* cited by examiner

*Primary Examiner* — Jacob K Ackun

(57) ABSTRACT

A chainsaw blade storing assembly for preventing the chainsaw blade from becoming twisted or tangled includes a case carried by a user. A plurality of rails is coupled to the case. The plurality of rails are positioned on opposite side of an interior of the case. The at least one chainsaw blade is positionable within the case. The at least one chainsaw blade extends around each of the plurality of rails. The at least one chainsaw blade is retained in the ovoid shape. A plurality of flaps is operationally coupled to the case. Each of the plurality of flaps engages an associated one of the plurality of rails. The at least one chainsaw blade is retained within the case.

15 Claims, 3 Drawing Sheets

CHAINSAW BLADE STORING ASSEMBLY

BACKGROUND OF THE DISCLOSURE

Field of the Disclosure

The disclosure relates to chainsaw blade storing devices and more particularly pertains to a new chainsaw blade storing device for preventing the chainsaw blade from becoming twisted or tangled.

SUMMARY OF THE DISCLOSURE

An embodiment of the disclosure meets the needs presented above by generally comprising a case carried by a user. A plurality of rails is coupled to the case. The plurality of rails are positioned on opposite side of an interior of the case. The at least one chainsaw blade is positionable within the case. The at least one chainsaw blade extends around each of the plurality of rails. The at least one chainsaw blade is retained in the ovoid shape. A plurality of flaps is operationally coupled to the case. Each of the plurality of flaps engages an associated one of the plurality of rails. The at least one chainsaw blade is retained within the case.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
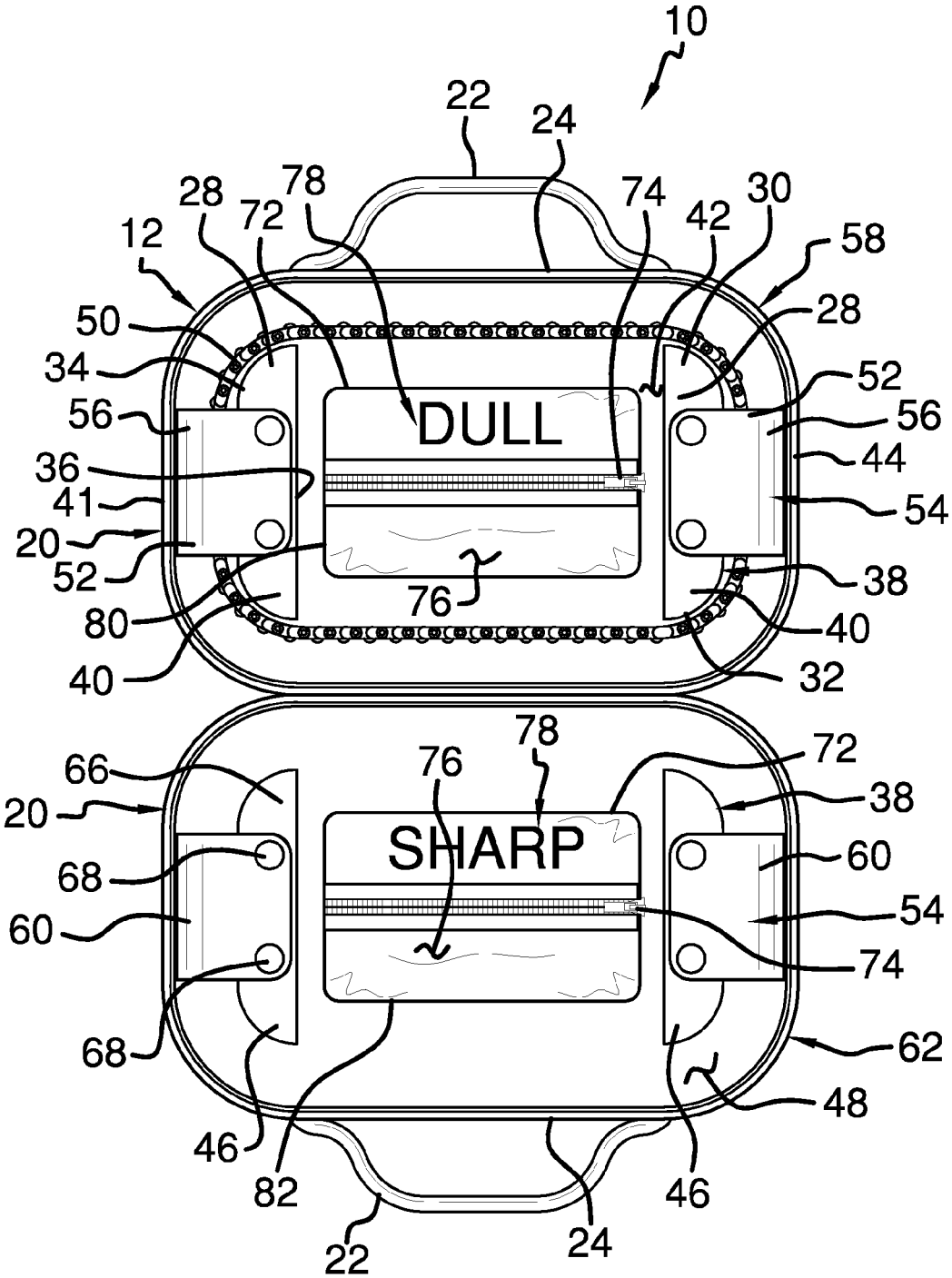
FIG. 1 is a top view of a chainsaw blade storing assembly according to an embodiment of the disclosure.
Figure 2:
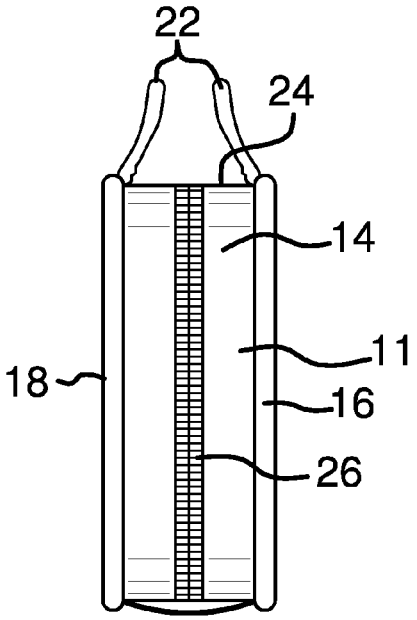
FIG. 2 is a right side view of an embodiment of the disclosure.
Figure 3:
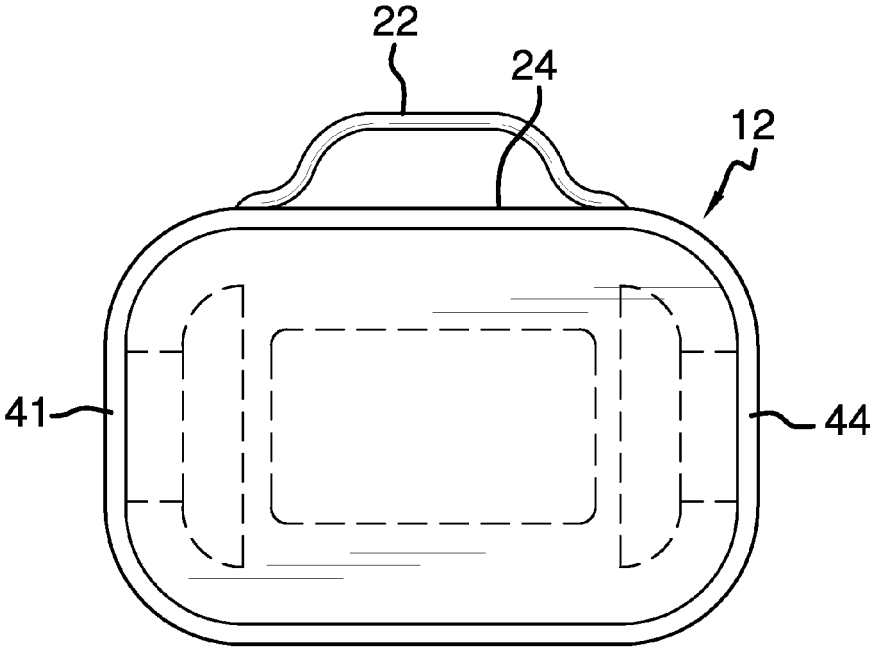
FIG. 3 is a front view of an embodiment of the disclosure.
Figure 4:
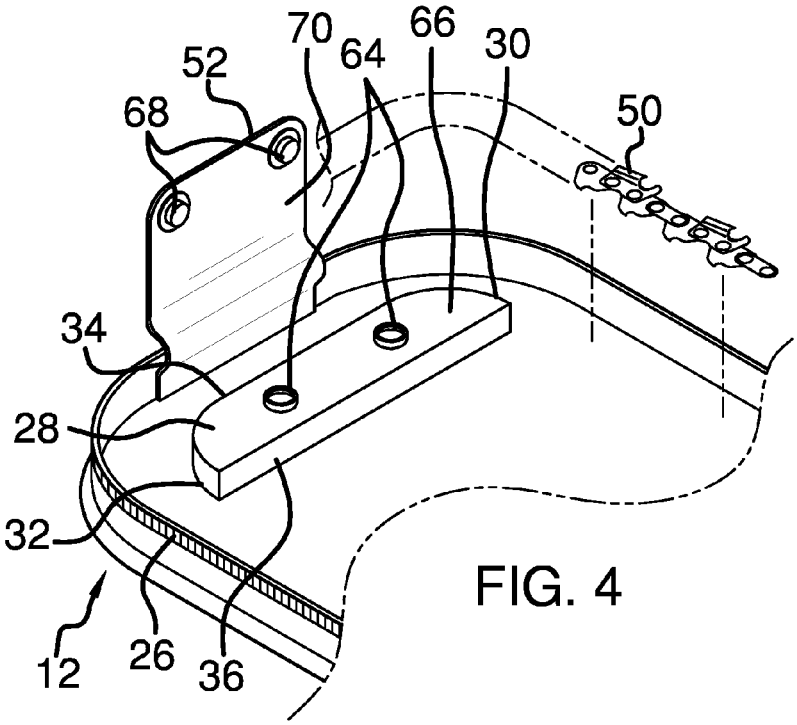
FIG. 4 is a perspective view of an embodiment of the disclosure.
Figure 5:
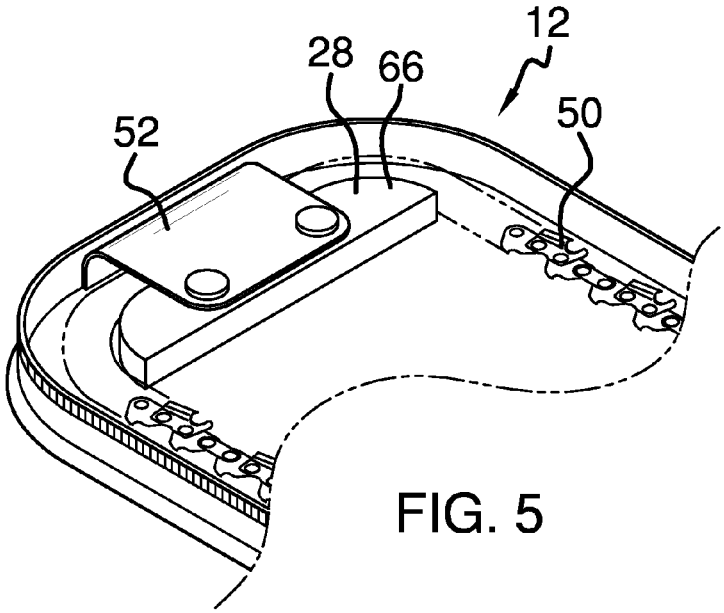
FIG. 5 is a top perspective view of an embodiment of the disclosure.

With reference now to the drawings, and in particular to FIGS. 1 through 5 thereof, a new chainsaw blade storing device embodying the principles and concepts of an embodiment of the disclosure and generally designated by the reference numeral 10 will be described.

As best illustrated in FIGS. 1 through 5, the chainsaw blade storing assembly 10 generally comprises a case 12. An exterior wall 14 of the case 12 extends between each of a top wall 16 and a bottom wall 18 of the case 12. The exterior wall 14 of the case 12 is substantially split. Moreover, the case 12 is divided into a pair of halves 20. Each of the pair of halves 20 of the case 12 is positionable between an open position and a closed position.

A pair of handles 22 is each coupled to a front side 24 of the exterior wall 14 of an associated one of each of the pair of halves 20 of the case 12. The pair of handles 22 may be gripped so the case 12 may be carried by a user. Each of the pair of halves 20 of the case 12 has a length that is greater than a width of each of the pair of halves 20 of the case 12. The case 12 has an ovoid shape.

A fastener 26 is coupled to the exterior wall 14 of the case 12. The fastener 26 is coextensive with the split in the exterior wall 14 of the case 12. The fastener 26 may be a zipper of any conventional design. The fastener 26 retains each of the pair of halves 20 of the case 12 in the closed position.

A plurality of rails 28 each has a first end 30 and a second end 32. The plurality of rails 28 is elongated. An outer side 34 of each of the plurality of rails 28 is convexly arcuate with respect to an inner side 36 of each of the plurality of rails 28. Each of the plurality of rails 28 has a semi-ovoid shape.

The plurality of rails 28 comprises a pair of sets of the plurality of rails 38. Each of a first one of the pair of sets of the plurality of rails 40 is coupled to an inner surface 42 of the top wall 16 of the case 12. The outer side 34 of each of the first set of the plurality of rails 40 is positioned proximate an associated one of a first lateral side 41 and a second lateral side 44 of the exterior wall 14 of the case 12. Each of a second one of the pair of sets of the plurality of rails 46 is coupled to an inside surface 48 of the bottom wall 18 of the case 12. The outer side 34 of each of the second set of the plurality of rails 46 is positioned proximate an associated one of the first lateral side 41 and the second lateral side 44 of the exterior wall 14 of the case 12.

At least one chainsaw blade 50 is positionable within the case 12. The at least one chainsaw blade 50 extends around a selected one of the first 40 or second 46 sets of the plurality of rails. The at least one chainsaw blade 50 is retained in an ovoid shape so the at least one chainsaw blade 50 does not become twisted or tangled. Additionally, the at least one chainsaw blade 50 may be a chainsaw blade of any conventional design.

A plurality of flaps 52 is provided. The plurality of flaps 52 comprises a pair of sets of the plurality of flaps 54. Each of a first one of the pair of sets of the plurality of flaps 56 is coupled to an associated one of the first lateral side 41 and the second lateral side 44 of the exterior wall 14 of a first one of the pair of halves 58 of the case 12. Continuing, each of the first set of the plurality of flaps 56 engages an associated one of the first set of the plurality of rails 40. The first set of flaps 56 retains the at least one chainsaw blade 50 within the case 12.

Each of a second one of the pair of sets of the plurality of flaps 60 is coupled to an associated one of the first lateral side 41 and the second lateral side 44 of the exterior wall 14 of a second one of the pair of halves 62 of the case 12. Each of the second set of the plurality of flaps 60 engages an associated one of the second set of the plurality of rails 46. The second set of flaps 60 retains the at least one chainsaw blade 50 within the case 12.

A pair of first couplers 64 is coupled to an uppermost side 66 of each of the first 40 and second 46 sets of the plurality of rails. A pair of second couplers 68 is coupled to a bottommost side 70 of each of the first 56 and second 60 sets of the plurality of flaps. The first 64 and second 68 couplers are complimentary. The first 64 and second 68 couplers retains each of the plurality of flaps 52 on the associated one of the plurality of rails 38. Finally, each of the first 64 and second 68 couplers may comprise snaps of any conventional design.

A pair of pouches 72 is each coupled to an associated one of the inner surface 42 of the top wall 16 of the case 12 and the inside surface 48 of the bottom wall 18 of the case 12. The pair of pouches 72 are positioned between an associated one of the first set of the plurality of rails 40 and the second set of the plurality of rails 46. A pair of fasteners 74 is coupled to a top surface 76 of an associated one of each of the pair of pouches 72. The pair of fasteners 74 may comprise a zipper of any conventional design.

Indicia 78 is printed on the top surface 76 of each of the pair of pouches 72. The indicia 78 on a first one of pair of pouches 80 may comprise the word "dull". The indicia 78 on a second one of the pair of pouches 82 may comprise the word "sharp" Each of the first 80 and second 82 pouches may contain tools related to the maintenance of chainsaws.

An exterior pocket 84 is coupled to and positioned on an exterior face of either the top wall 16 or the bottom wall 18. As shown, the exterior pocket 84 is positioned on the top wall 16. The exterior pocket 84 has a closure 86, such as a door 88 positioned at an end of the exterior pocket 84, allowing selective access to the exterior pocket 84. The exterior pocket 84 is sized to hold a spare bar for a chainsaw. Thus, the exterior pocket 84 will typically have a length of at least 25 centimeters.

In use, at least one chainsaw blade 50 is positionable around the first set of the plurality of rails 40 in the first half 58 of the case 12. The at least one chainsaw blade 50 positioned in the first half 58 of the case 12 is a chainsaw blade 50 in need of sharpening. At least one chainsaw blade 50 is positionable around the second set of the plurality of rails 46 in the second half 62 of the case 12. The at least one chainsaw blade 50 positioned in the second half 62 of the case 12 is a chainsaw blade 50 that is sharpened and ready for use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A chainsaw blade storing assembly for storing at least one chainsaw blade in an ovoid shape such that the at least one chainsaw blade does not become tangled or twisted, said assembly comprising:

a case;

a plurality of rails coupled to said case such that said plurality of rails are positioned on opposite side of an interior of said case, the at least one chainsaw blade being positionable within said case having the at least one chainsaw blade extending around each of said plurality of rails such that the at least one chainsaw blade is retained in the ovoid shape; and a plurality of flaps operationally coupled to said case, each of said plurality of flaps engaging an associated one of said plurality of rails such that the at least one chainsaw blade is retained within said case.

2. The assembly according to claim 1, wherein said case having an exterior wall of said case extending between each of a top wall and a bottom wall of said case.

3. The assembly according to claim 1, wherein an exterior wall of said case being substantially split having said case being divided into two halves, each of said two halves of said case being positionable between an open position and a closed position.

4. The assembly according to claim 1, wherein said plurality of rails each having a first end and a second end, said plurality of rails being elongated.

5. The assembly according to claim 1, wherein an outer side of each of said plurality of rails being convexly arcuate with respect to an inner side of each of said plurality of rails such that each of said plurality of rails has a semi-ovoid shape.

6. The assembly according to claim 1, wherein said plurality of rails comprising a pair of sets of said plurality of rails.

7. The assembly according to claim 6, wherein each of a first one of said pair of sets of said plurality of rails being coupled to an inner surface of a top wall of said case such that an outer side of each of said first set of said plurality of rails is positioned proximate an associated one of a first lateral side and a second lateral side of an exterior wall of said case.

8. The assembly according to claim 6, wherein each of a second one of said pair of sets of said plurality of rails being coupled to an inside surface of a bottom wall of said case such that an outer side of each of said second set of said plurality of rails is positioned proximate an associated one of a first lateral side and a second lateral side of an exterior wall of said case.

9. The assembly according to claim 1, wherein said plurality of flaps comprising a pair of sets of said plurality of flaps.

10. The assembly according to claim 9, wherein each of a first one of said pair of sets of said plurality of flaps being coupled to an associated one of a first lateral side and a second lateral side of an exterior wall of a first one of a pair of halves of said case.

11. The assembly according to claim 10, wherein each of said first set of said plurality of flaps engaging an associated one of a first set of said plurality of rails.

12. The assembly according to claim 9, wherein each of a second one of said pair of sets of said plurality of flaps being coupled to an associated one of a first lateral side and a second lateral side of an exterior wall of a second one of a pair of halves of said case.

13. The assembly according to claim 12, wherein each of said second set of said plurality of flaps engaging an associated one of a second set of said plurality of rails.

14. The assembly according to claim 1, wherein a pair of pouches each coupled to an associated one of a inner surface of a top wall of said case and an inside surface of a bottom wall of said case such that said pair of pouches are positioned between an associated one of a first set of said plurality of rails and a second set of said plurality of rails.

15. A chainsaw blade storage assembly for storing at least one chainsaw blade in an ovoid shape such that the at least one chain saw blade does not become tangled or twisted, said assembly comprising:

a case having an exterior wall of said case extending between each of a top wall and a bottom wall of said case, said exterior wall of said case being substantially split having said case being divided into two halves, each of said two halves of said case being positionable between an open position and a closed position;

a plurality of rails each having a first end and a second end, said plurality of rails being elongated, an outer side of each of said plurality of rails being convexly arcuate with respect to an inner side of each of said plurality of rails such that each of said plurality of rails has a semi-ovoid shape, said plurality of rails comprising a pair of sets of said plurality of rails;

each of a first one of said pair of sets of said plurality of rails being coupled to an inner surface of said top wall of said case such that said outer side of each of said first set of said plurality of rails is positioned proximate an associated one of a first lateral side and a second lateral side of said exterior wall of said case;

each of a second one of said pair of sets of said plurality of rails being coupled to an inside surface of said bottom wall of said case such that said outer side of each of said second set of said plurality of rails is positioned proximate an associated one of said first lateral side and said second lateral side of said exterior wall of said case;

the at least one chainsaw blade being positionable within said case having the at least one chainsaw blade extending around a selected one of said first or second sets of said plurality of rails such that the at least one chainsaw blade is retained in the ovoid shape;

a plurality of flaps comprising a pair of sets of said plurality of flaps;

each of a first one of said pair of sets of said plurality of flaps being coupled to an associated one of said first lateral side and said second lateral side of said exterior wall of a first one of said pair of halves of said case, each of said first set of said plurality of flaps engaging an associated one of said first set of said plurality of rails such that the at least one chainsaw blade is retained within said case;

each of a second one of said pair of sets of said plurality of flaps being coupled to an associated one of said first lateral side and said second lateral side of said exterior wall of a second one of said pair of halves of said case, each of said second set of said plurality of flaps engaging an associated one of said second set of said plurality of rails such that the at least one chainsaw blade is retained within said case; and a pair of pouches each coupled to an associated one of said inner surface of said top wall of said case and said inside surface of said bottom wall of said case such that said pair of pouches are positioned between an associated one of said first set of said plurality of rails and said second set of said plurality of rails.

* * * * *